US008500488B2

(12) United States Patent
Hsu et al.

(10) Patent No.: US 8,500,488 B2
(45) Date of Patent: Aug. 6, 2013

(54) ELECTRICAL CONNECTOR HAVING METAL SHELL WITH RETAINING TAB FOR ENGAGING WITH INSULATIVE HOUSING

(75) Inventors: Hsiu-Yuan Hsu, New Taipei (TW); Chun-Fu Lin, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/407,725

(22) Filed: Feb. 28, 2012

(65) Prior Publication Data

US 2012/0225595 A1 Sep. 6, 2012

(30) Foreign Application Priority Data

Mar. 3, 2011 (TW) ..... 100203697
Mar. 17, 2011 (TW) ..... 100204810

(51) Int. Cl.
*H01R 13/648* (2006.01)

(52) U.S. Cl.
USPC ..... 439/607.31

(58) Field of Classification Search
USPC ..... 439/607.35, 607.36, 607.01, 607.31
See application file for complete search history.

(56) References Cited

U.S. PATENT DOCUMENTS

| | | | | |
|---|---|---|---|---|
| 7,467,964 | B2 * | 12/2008 | Hsu et al. | 439/331 |
| 8,021,187 | B2 * | 9/2011 | Tagawa et al. | 439/607.31 |
| 2004/0121631 | A1 * | 6/2004 | Fan | 439/79 |
| 2006/0121781 | A1 * | 6/2006 | Zhang et al. | 439/607 |
| 2007/0123094 | A1 * | 5/2007 | Su et al. | 439/492 |
| 2007/0134964 | A1 * | 6/2007 | Hsu et al. | 439/188 |
| 2007/0212940 | A1 * | 9/2007 | Ker et al. | 439/607 |
| 2010/0285692 | A1 * | 11/2010 | Zhang | 439/607.01 |
| 2012/0225595 | A1 * | 9/2012 | Hsu et al. | 439/892 |

* cited by examiner

*Primary Examiner* — James Harvey
(74) *Attorney, Agent, or Firm* — Wei Te Chung; Ming Chieh Chang

(57) ABSTRACT

An electrical connector includes an insulative housing (1), a plurality of contact terminals (2) arranged in an X direction and a metallic shell (3) covering an outside of the insulative housing thereby forming a mating space (151) with a mating opening (152). The metallic shell (3) has a main plate (30) and a plurality of T-shaped retaining tabs (31) extending into mating space from the main plate and engaging with an inner surface (111) of the side wall (11).

17 Claims, 13 Drawing Sheets

ELECTRICAL CONNECTOR HAVING METAL SHELL WITH RETAINING TAB FOR ENGAGING WITH INSULATIVE HOUSING

BACKGROUND OF THE INVENTION

1. Field of the Invention

The present invention relates to an electrical connector, and more particularly to an electrical connector having metal shell with a retaining tab creating an interengagment between the metal shell and the housing retaining tab formed by the metal shell.

2. Description of the Related Art

U.S. Pat. No. 8,021,187 issued to Tagawa et al. on Sep. 20, 2011, discloses an electrical connector mating with a cable assembly for transmitting LVDS (Low-Voltage Differential Signaling) signal. The electrical connector includes an insulative housing, a plurality of terminals retained in the insulative housing and a metal shell covering on the housing. The terminals are arranged in a longitudinal direction in which the insulative housing extending. Each of the terminals has a retaining portion, a contacting portion extending from one end of the retaining portion in a mating direction perpendicular to the longitudinal direction and a soldering portion extending out of the insulative housing from another end of the retaining portion. The metal shell includes a body portion surrounding the insulative housing and a plurality of engaging holes extending from end edge of the body portion. The insulative housing has a plurality of engaging projections provided on an opening end edge thereof and inserting into the engaging hole.

The insulating housing and the metal shell are interlocked to each other in the longitudinal direction and a vertical direction orthogonal to the mating direction by inserting the engaging projection into the engaging hole so that rigidity is largely increased. The anchoring mechanism of the insulating housing and the metal shell do not project inside the insulating housing so that it is possible to reduce the height and make pitches fine. However, when the metal shell is mounted on the insulative housing, the engaging holes and the engaging projections are not easily disposed arranged in alignment with each other.

Therefore, an improved electrical connector is desired to overcome the disadvantages of the related arts.

SUMMARY OF THE INVENTION

An object of the present invention is to provide an electrical connector overcoming disadvantage of the metal shell which is suffered with misalignment with the insulative housing and accidentally disengaging with the insulative housing.

In order to achieve the above-mentioned object, an electrical connector in accordance with a preferred embodiment of the present invention includes an insulative housing having at least one side wall with an inner surface and an outer surface, a plurality of contact terminals arranged in a longitudinal direction and a metallic shell covering an outside of the insulative housing thereby forming a mating space. The metallic shell includes a main plate with a plurality of retaining tabs extending therefrom. The tab further includes ears engaged with the insulative housing.

Other objects, advantages and novel features of the invention will become more apparent from the following detailed description of the present embodiment when taken in conjunction with the accompanying drawings.

DETAILED DESCRIPTION OF THE INVENTION

Figure 1:
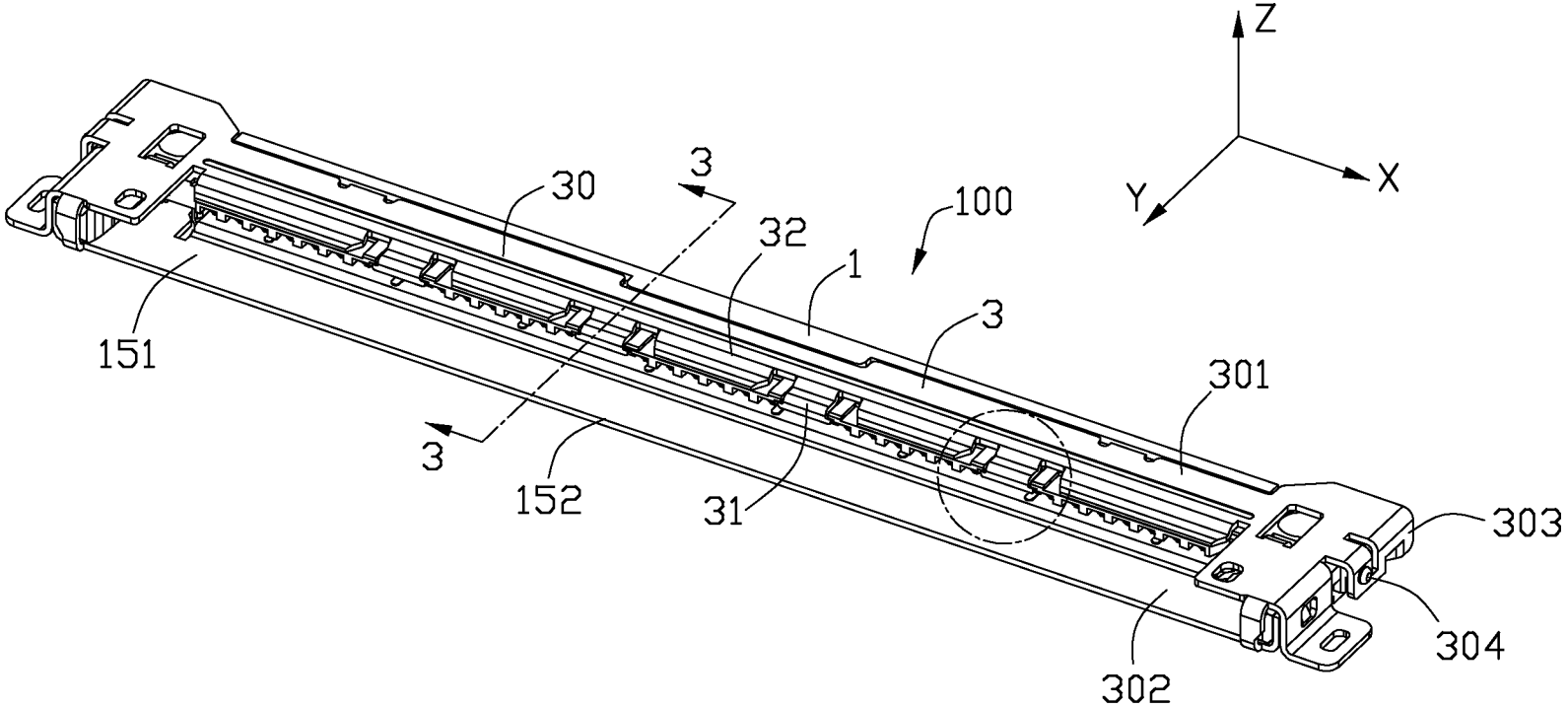
FIG. 1 is a perspective view of an electrical connector in accordance with the preferred embodiment of the present invention.

Reference will now be made to the drawing figures to describe the preferred embodiments of the present invention in detail.

Figure 2:
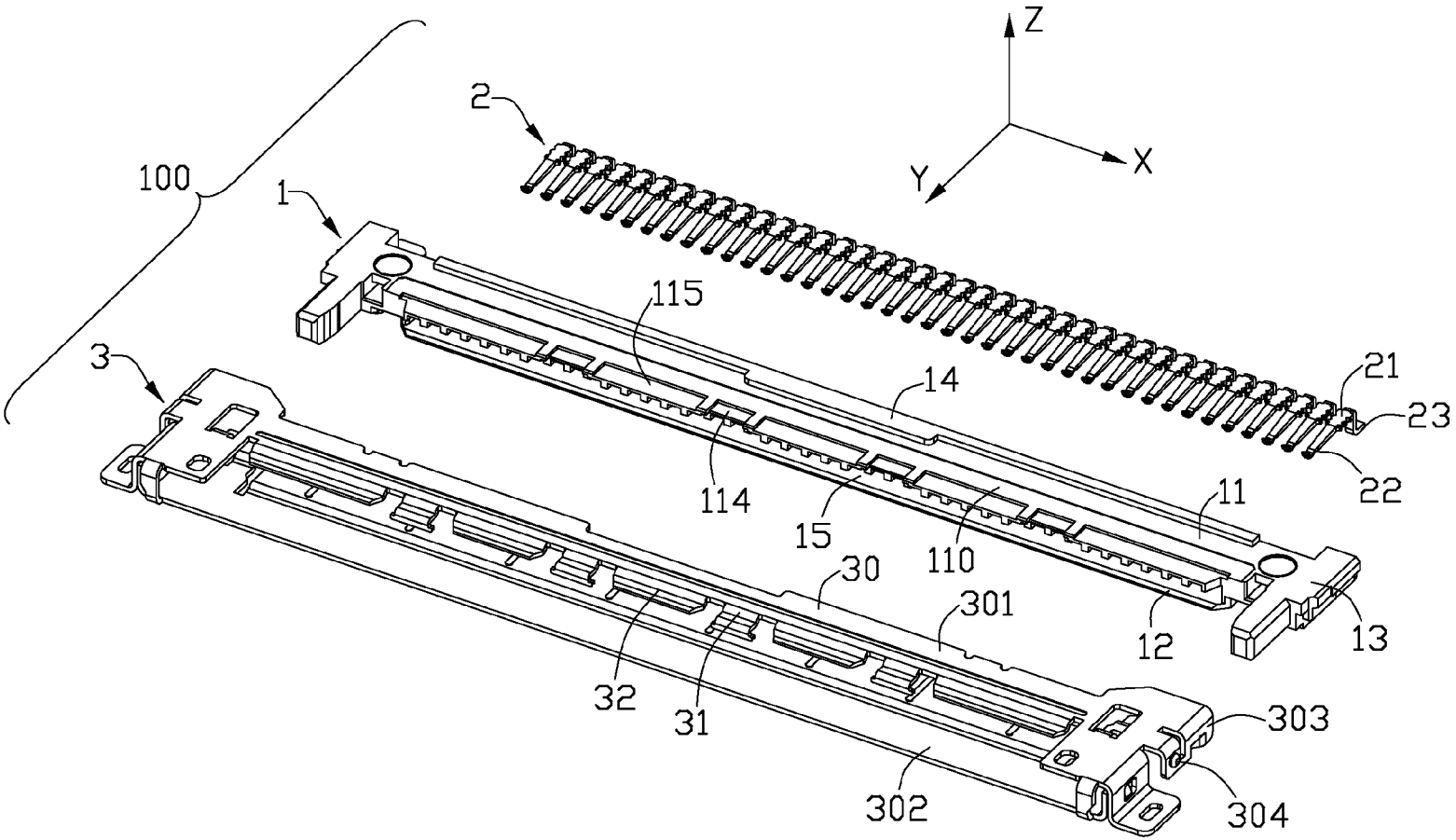
FIG. 2 is an exploded perspective view of the electrical connector of FIG. 1.

Referring to FIGS. 1 and 2, an electrical connector 100 includes an insulative housing 1, a plurality of contact terminals 2 arranged in the insulative housing 1 in an X direction (i.e. a longitudinal direction) and a metallic shell 3 covering an outside of the insulative housing.

Figure 3:
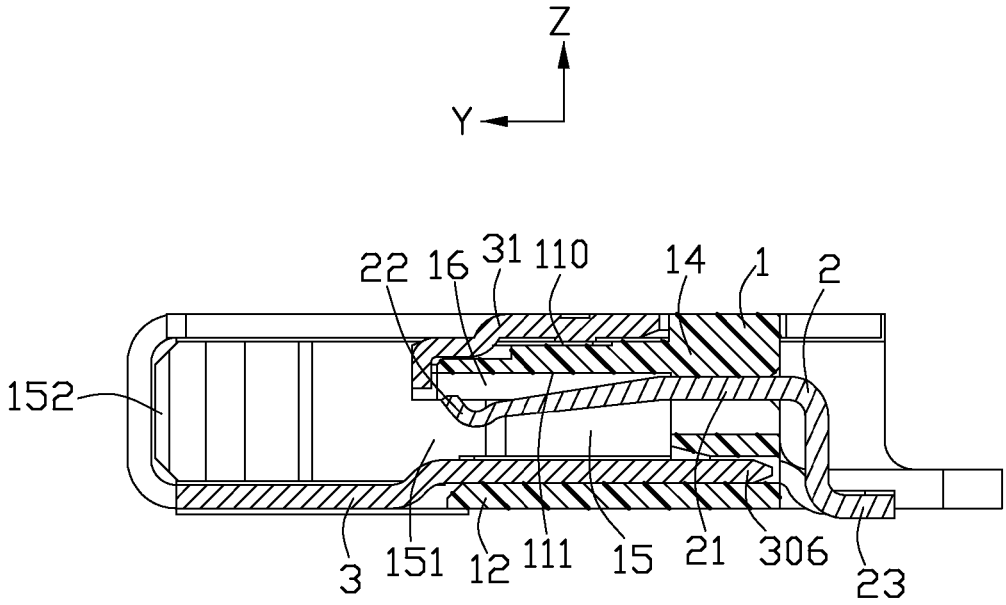
FIG. 3 is a cross-section view of the electrical connector taken along line 3-3 of FIG. 1.

Referring to FIGS. 2 and 3, the insulative housing 1 includes a first side wall 11, a second side wall 12 opposite to the first side wall 11 and a pair of end side walls 13 thereby forming a base portion 14 disposed at a rear side thereof and a receiving space 15 disposed at a front side thereof. The insulative housing defines a plurality of grooves 16 for receiving contact terminals 2. The contact terminals 2 are inserted into the grooves 16 along a Y direction (i.e. a mating direction) perpendicular to the X direction. The contact terminal 2 includes a retaining portion 21 retained in the base portion 14, a contacting portion 22 which extends from one end of the retaining portion 21 and protrudes into the receiving space 15 for electrically connecting with a mating connector (not shown) and a soldering portion 23 disposed at another end of the retaining portion 21 and extending out of the insulative housing 1 for soldering on a printed circuit board (not shown).

Referring to FIGS. 1 to 3, the metallic shell 3 is mounted onto the insulative housing 1 in an opposite direction of the Y direction and shields the insulative housing thereby forming a mating space 151 with an mating opening 152 for receiving the mating connector. The mating space 151 communicates with the grooves 16 for permitting the contact terminals 2 extending into the mating space 151 and electrically connecting with the mating connector. The metallic shell 3 includes a main plate 30 surrounding the insulative housing 1, a plurality of retaining tabs 31 extending therefrom and a plurality of guiding portions 32 staggering with the retaining tabs 31. Both of the retaining tabs 31 and guiding portions 32 extend towards the mating opening 152 from the main plate 30 along the Y direction. The main plate 30 has an upper wall 301 shielding the first side wall 11, a bottom wall 302 covering the second side wall 12 and end wall 303 shielding the end side walls 13 and unitarily connecting with the upper wall 301 or the bottom wall 302 for improving strength of the metallic shell 3. The end wall 303 defines a locking projection 304 for locking with mating connector.

Figure 4:
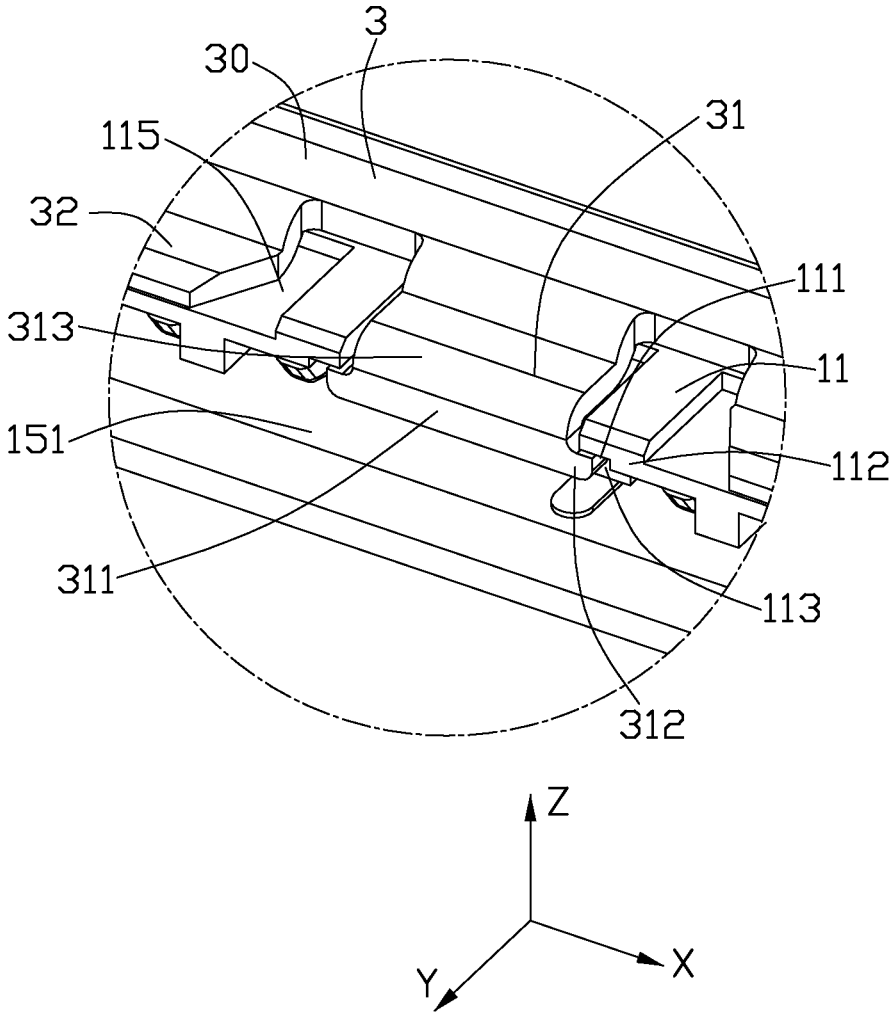
FIG. 4 is a partly enlarged view of FIG. 1.
Figure 5:
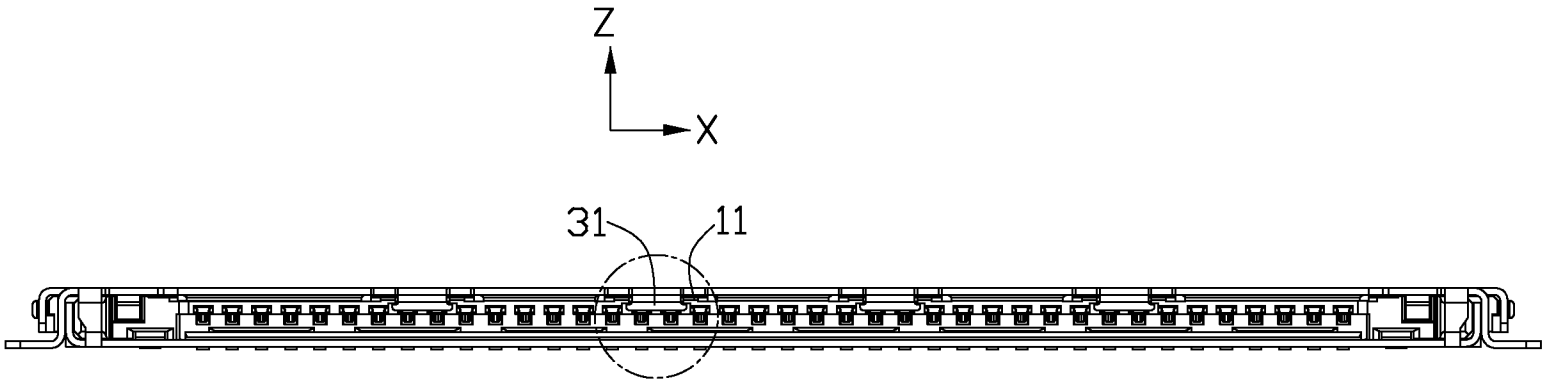
FIG. 5 is a front elevation view of the electrical connector of FIG. 1.
Figure 6:
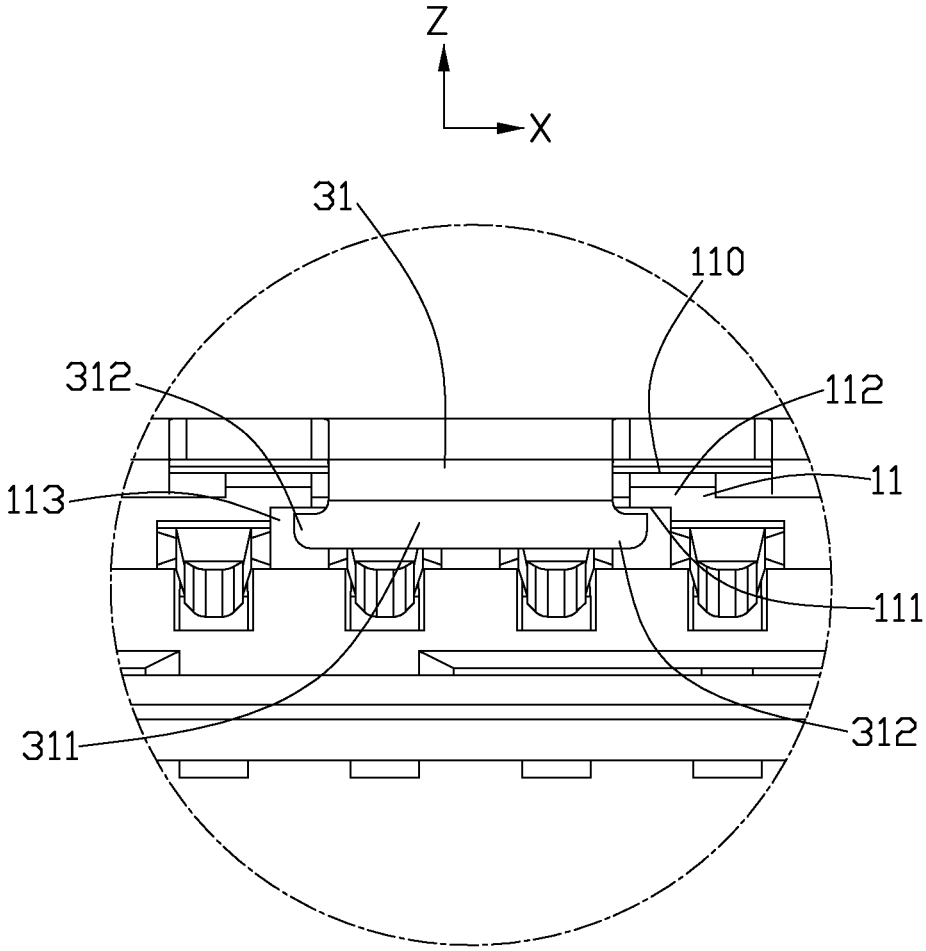
FIG. 6 is a partly enlarged view of FIG. 5.
Figure 7:
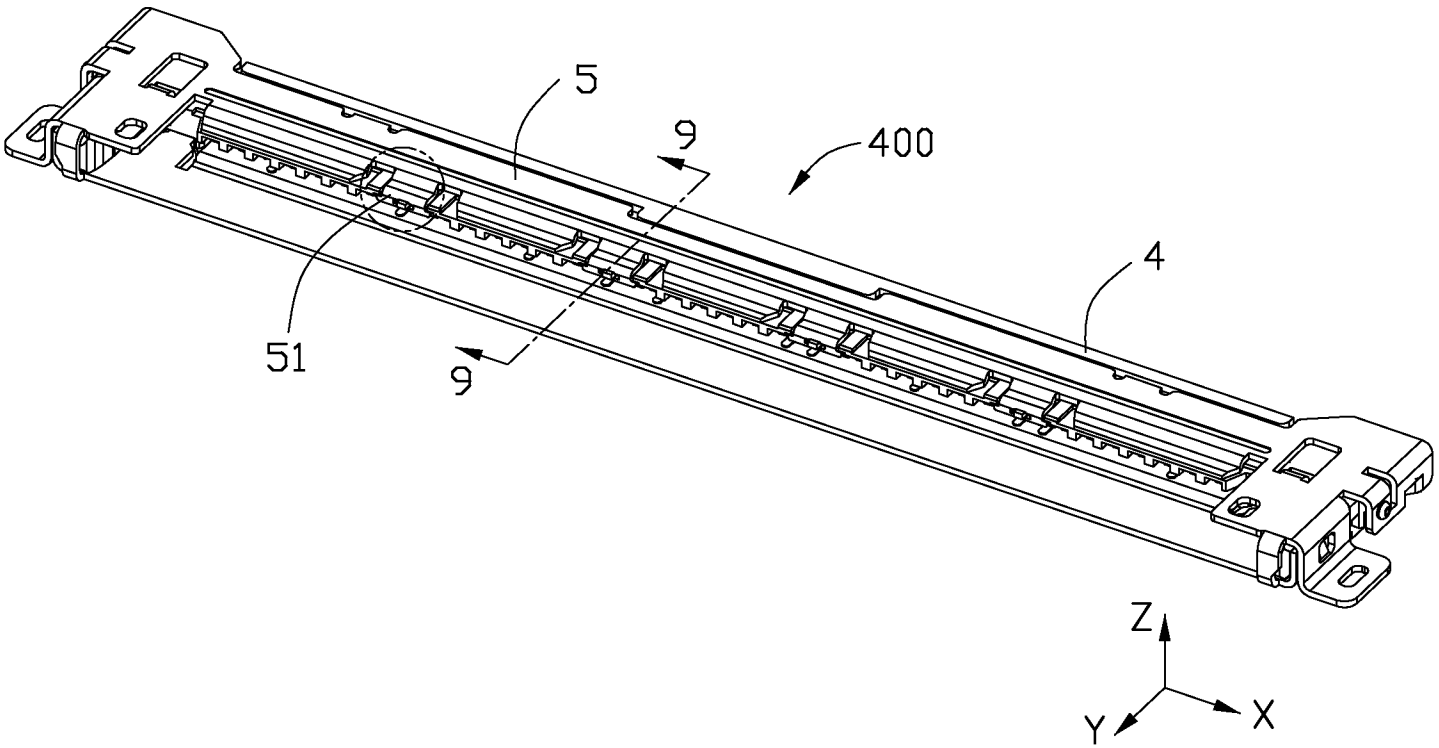
FIG. 7 is a perspective view of a half-finished electrical connector in accordance with another embodiment of the present invention.
Figure 8:
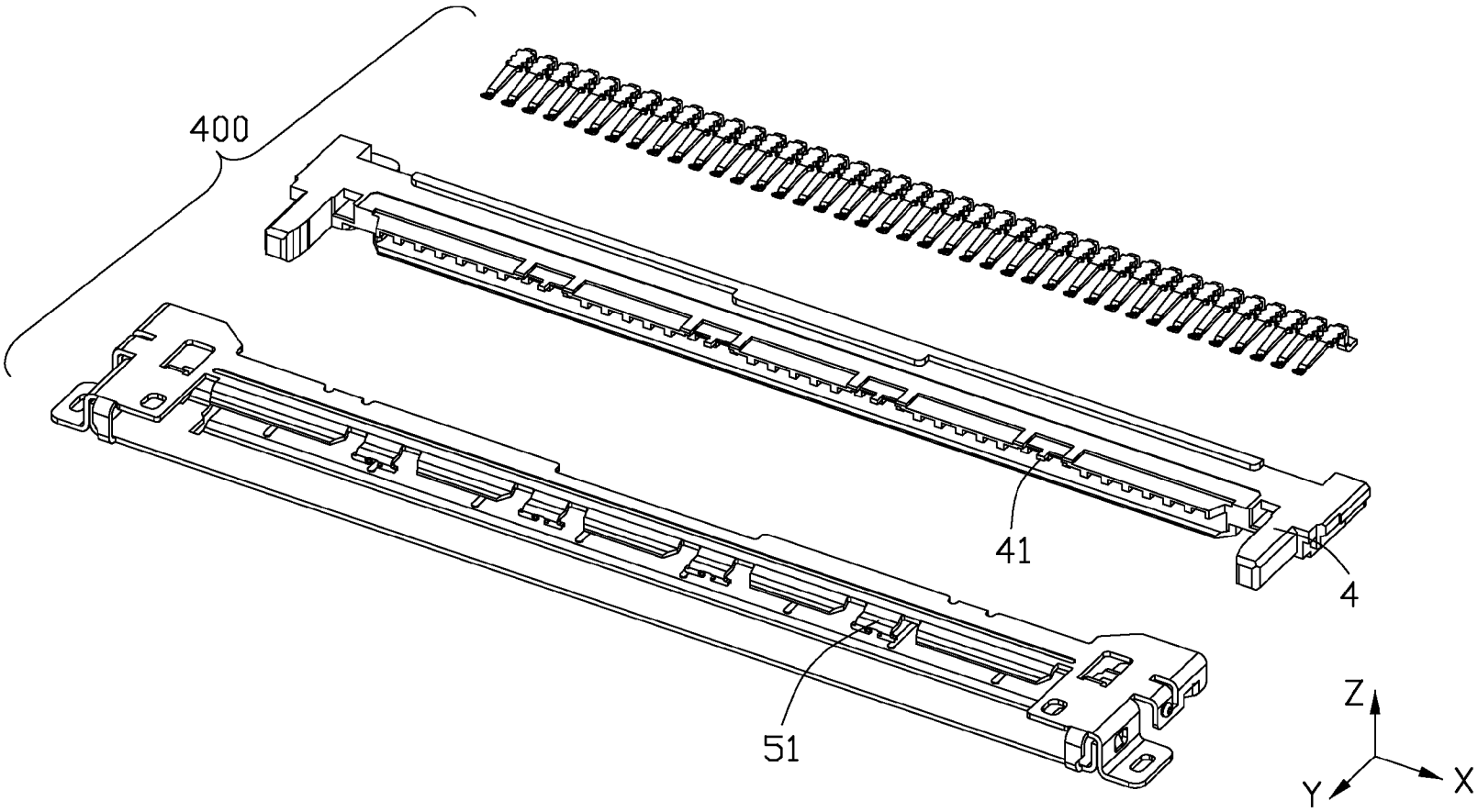
FIG. 8 is an exploded perspective view of the electrical connector of FIG. 7.
Figure 9:
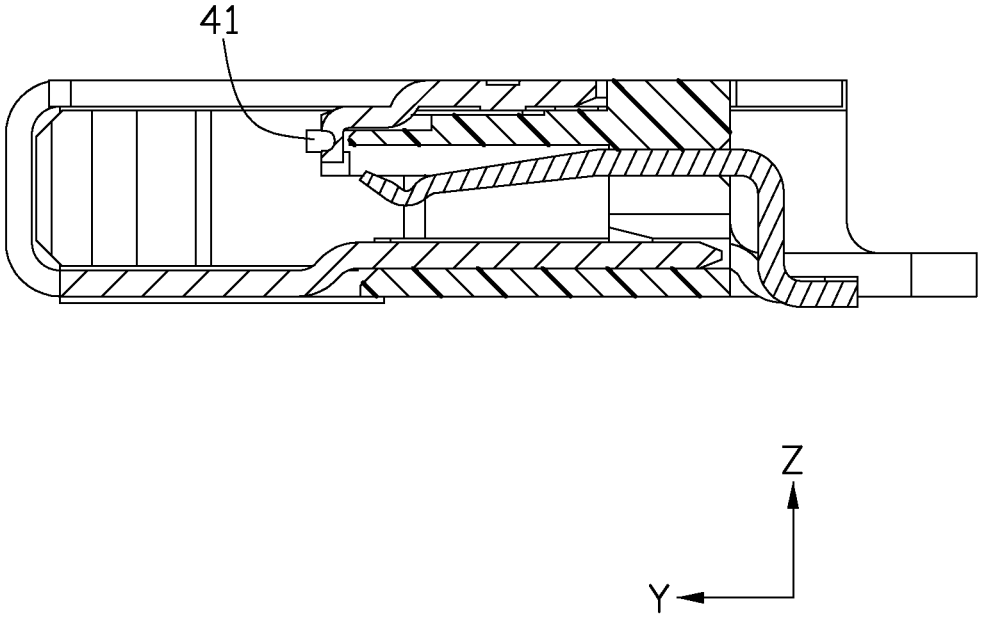
FIG. 9 is a cross-section view of the electrical connector taken along line 9-9 of FIG. 7.
Figure 10:
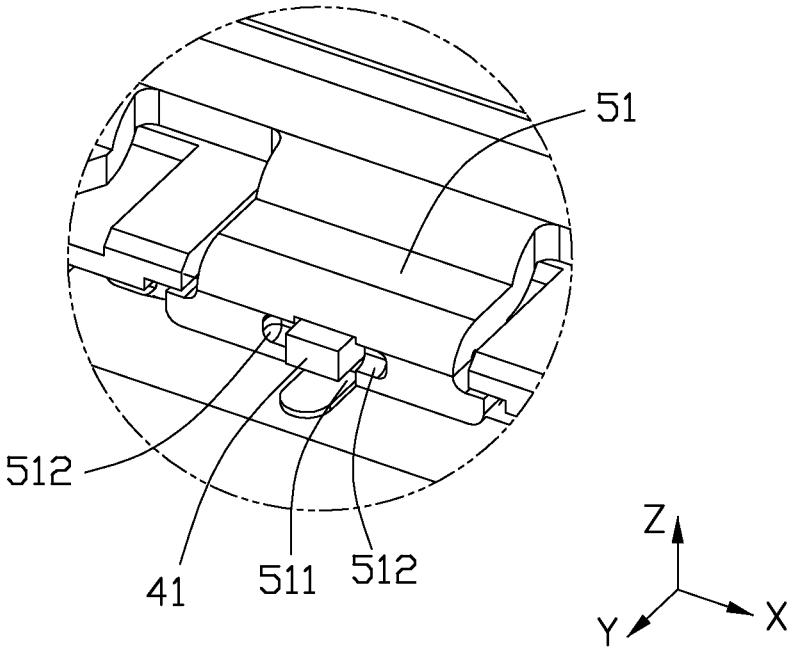
FIG. 10 is a partly enlarged view of FIG. 7.

Referring to FIGS. 4 to 6, the first side wall 11 of the insulative housing 1 defines an outer surface 110 and an inner surface 111. Each of the retaining tabs 31 includes a main body 311 which extends from the main plate 30 and defines a turning portion 313, and a pair of locking ears 312 engaged with the insulative housing 1 and disposed perpendicular to the main plate 30. The locking ears 312 extend into a front edge of the mating opening 152 along the X direction and are opposite to the inner surface 111 of the first side wall 11, i.e. the retaining tab 31 firstly extends from the first side wall 11, then turns to the inner surface 111 of the first side wall 11 in a Z direction (i.e. a vertical direction) perpendicular to the X, Y directions, thereby engaging with a front edge 112 of the first side wall 11 for preventing the metallic shell 3 from deformation and moving in the Z direction.

Referring to FIGS. 2 to 4, the first side wall 11 of the insulative housing 1 defines a plurality of first recesses 113 corresponding with the locking ears 312, each of which respectively receives and retains the locking ear 312 for preventing the metallic shell 3 from moving in the X direction. The outer surface 110 of the first side wall 11 also defines a plurality of second recesses 114 receiving the retaining tab 31 and a plurality of third recesses 115 receiving the guiding portions 32 for holding the metallic shell 3 on the insulative housing 1. The main body 311 and the guiding portion 32 are lower than the body portion 30 for guiding the mating connector mating with the electrical connector 1. The bottom wall 302 has a holding portion 306 retained in the second side wall 12 for holding the metallic shell 3.

Referring to FIGS. 7 to 13, an electrical connector connector 400 of another embodiment of the present invention is shown, which is similar to that of aforementioned connector except a described retaining tab 51 formed by a metallic shell 5 and an insulative housing 4 engaging with the retaining tab 51. The insulative housing 4 defines a plurality of engaging projections 41 extending from front edge of the insulative housing 4 in the Y direction perpendicular to the X direction. The retaining tab 51 forms an engaging slot 511 and a pair of blind recesses 512 in communicating with the engaging slot 511.

Figure 11:
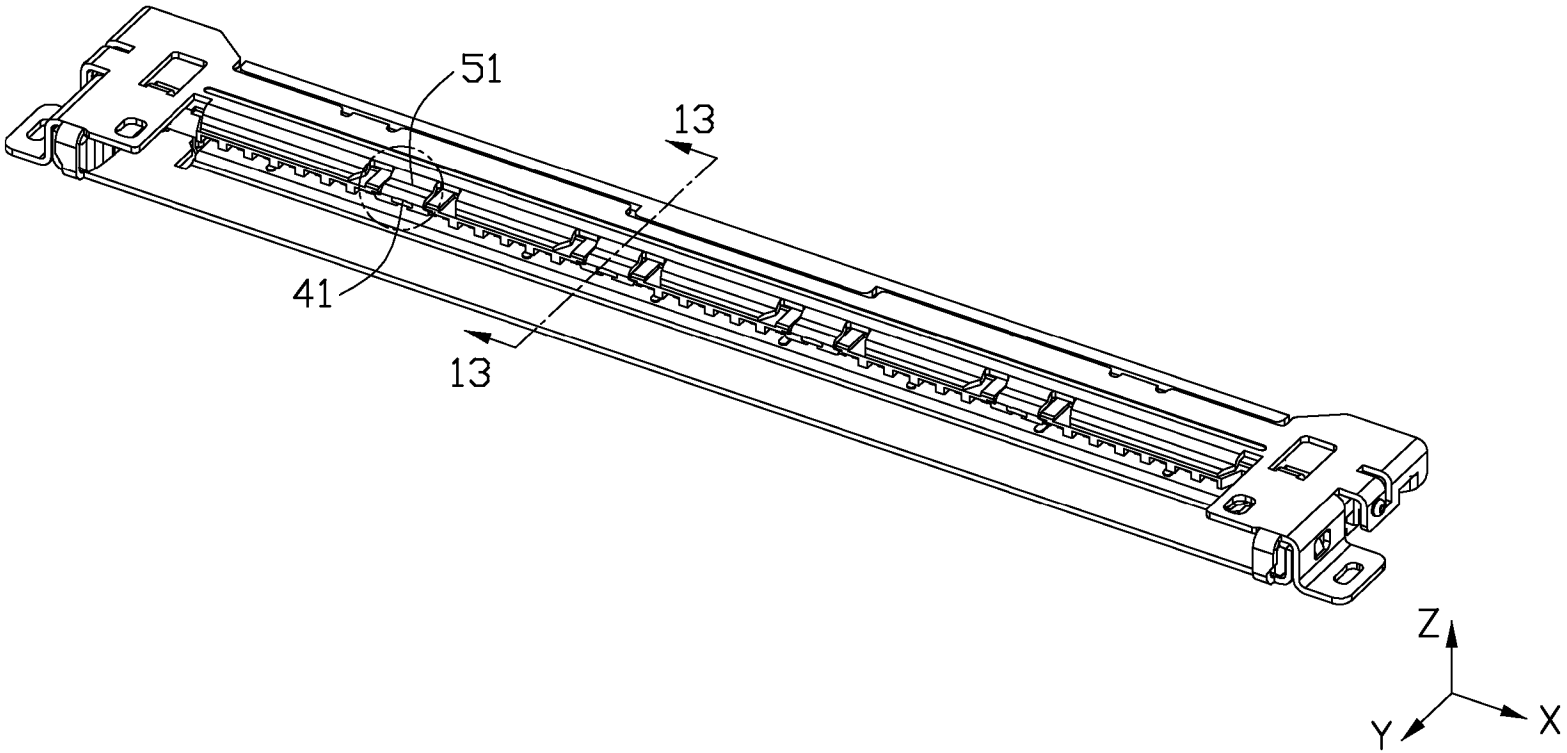
FIG. 11 is perspective view of the finished electrical connector processed by the half-finished electrical connector of FIG. 7.
Figure 12:
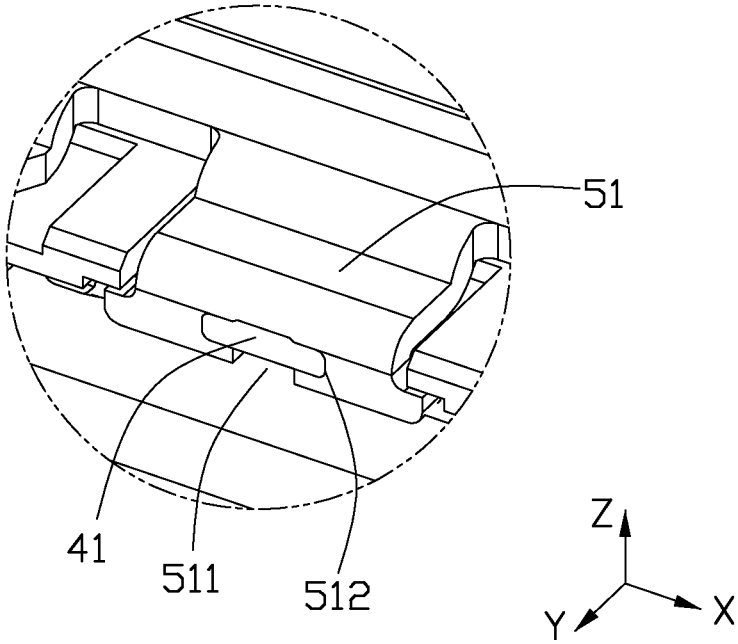
FIG. 12 is a partly enlarged view of FIG. 11.
Figure 13:
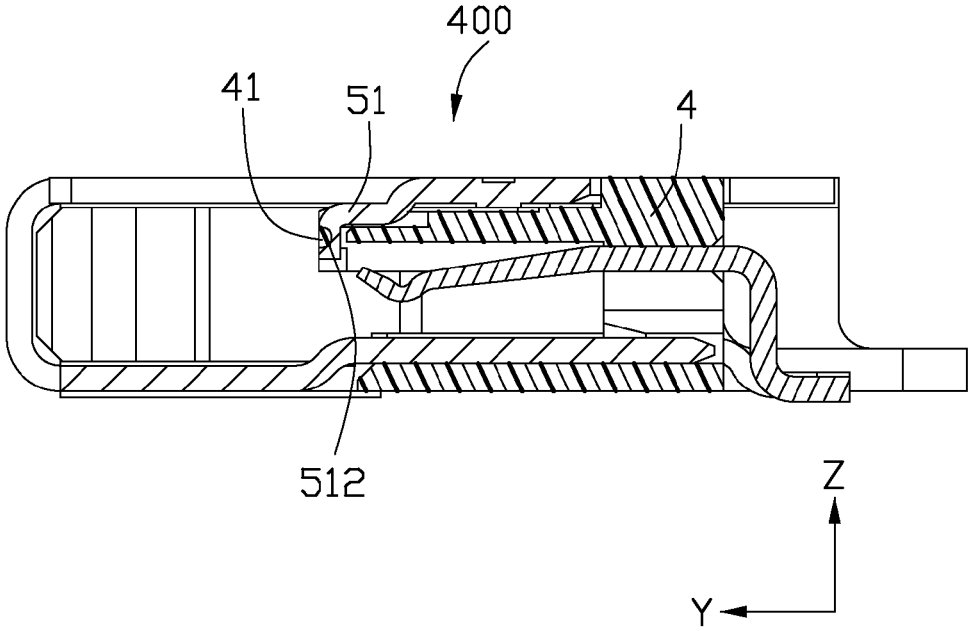
FIG. 13 is a cross-section view of the finished electrical connector taken along line 13-13 of FIG. 11.

Referring to FIGS. 11 to 13, firstly, the engaging slot 511 of the retaining tab 51 is alignment with and inserted into the engaging projection 41, secondly the engaging projection 41 are melted by a heat implement (not shown) and filled into the blind recesses 512. So the deformed engaging projection 41 is received in the engaging slot 511 and the blind recesses 512 for holding the retaining tab 51 and the insulative housing together. The blind recesses 512 are disposed at both side of the engaging slot 511 along the X direction for decreasing the size of electrical connector 400 in the Y direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

an insulative housing comprising at least one side wall with an inner surface and an outer surface;

a plurality of contact terminals arranged in a longitudinal direction;

a metallic shell covering an outside of the insulative housing thereby forming a mating space and comprising a main plate with a plurality of retaining tabs extending therefrom; and wherein each retaining tab further comprises locking ears engaged with the insulative housing:

the side wall of the insulative housing comprises a front edge, the locking ears extend under the front edge along the longitudinal direction; and the retaining tab comprises a main body which extends from the main plate, the locking ears are disposed perpendicular to the main plate and extend into the mating space and are facing to the inner surface of the first side wall.

2. An electrical connector comprising:

an elongated insulative housing extending in a lengthwise direction and defining opposite horizontal top and bottom walls with an elongated receiving space therebetween in a vertical direction perpendicular to said lengthwise direction;

a plurality of contacts disposed in the housing with contacting sections exposed in the receiving space; and a metallic shell configured to be rearwardly assembled to the housing only in a front-to-back direction perpendicular to both said lengthwise direction and said vertical direction; wherein the shell includes opposite horizontal upper and lower walls, said upper wall covering the top wall of the housing and unitarily forming a plurality of spaced T-shaped tabs with front sections upside down extending downwardly on a front edge region thereof with two lateral locking ends engaged within corresponding recesses formed in a front ledge of the top wall of the housing for anti-flap retention.

3. The electrical connector as claimed in claim 2, wherein the top wall of the housing defines a plurality of recess regions to receive the corresponding T-shaped tabs, respectively.

4. The electrical connector as described in claim 1, wherein the inner surface of the side wall comprises a plurality of first recesses corresponding with the locking ears, each of which respectively receives and retains the locking ear.

5. The electrical connector as described in claim 4, wherein the outer surface of the side wall comprises a plurality of second recesses receiving the retaining tab.

6. The electrical connector as described in claim 1, wherein the retaining tabs comprises a turning portion covering the front edge of the insulative housing.

7. The electrical connector as described in claim 1, wherein the metallic shell comprises a plurality of guiding portions staggering with the retaining tabs.

8. The electrical connector as described in claim 7, wherein the outer surface of the side wall comprises a plurality of third recesses receiving the guiding portions.

9. An electrical connector, comprising:

an insulative housing comprising at least one side wall with an inner surface and an outer surface;

a plurality of contact terminals arranged in a longitudinal direction;

a metallic shell covering an outside of the insulative housing thereby forming a mating space with a mating opening and comprising a main plate; and wherein the metallic shell comprising a plurality of T-shaped retaining tabs extending into the mating space from the main plate and engaging with the inner surface of the side wall.

10. The electrical connector as described in claim 9, wherein a T-shaped locking extends to a front edge of the mating opening from an outer edge of the main plate.

11. The electrical connector as described in claim 10, wherein the insulative housing comprises a plurality of engaging projections extending from a front edge of the side wall in a mating direction perpendicular to the longitudinal direction.

12. The electrical connector as described in claim 10, wherein the retaining tab comprises an engaging slot into which the engaging projection inserted into and a pair of blind recesses in communicating with the engaging slot for receiving the deformed engaging projection by melted process.

13. The electrical connector as claimed in claim 2, wherein each of said T-shaped tabs further defines a cutout into which a portion of the front edge of the top wall is received.

14. The electrical connector as claimed in claim 2, wherein said upper wall further includes a plurality of guiding portions alternately arranged with the T-shaped tabs in the lengthwise direction for assembling guiding.

15. The electrical connector as claimed in claim 14, wherein the top wall of the housing defines a plurality of recess regions to receive the corresponding T-shaped tabs and the guiding portions therein, respectively.

16. The electrical connector as claimed in claim 13, wherein said cutout is located at a center between two opposite lateral locking ends of the corresponding tab.

17. The electrical connector as claimed in claim 13, wherein said portion is deformed to fill the corresponding cutout.

* * * * *